US010566702B2

(12) United States Patent
Hashimoto

(10) Patent No.: US 10,566,702 B2
(45) Date of Patent: Feb. 18, 2020

(54) ANTENNA DEVICE AND ANTENNA APPARATUS

(71) Applicants: KABUSHIKI KAISHA TOSHIBA, Minato-ku (JP); TOSHIBA INFRASTRUCTURE SYSTEMS & SOLUTIONS CORPORATION, Kawasaki-shi (JP)

(72) Inventor: Koh Hashimoto, Yokohama (JP)

(73) Assignees: KABUSHIKI KAISHA TOSHIBA, Minato-ku (JP); TOSHIBA INFRASTRUCTURE SYSTEMS & SOLUTIONS CORPORATION, Kawasaki-shi (JP)

( * ) Notice: Subject to any disclaimer, the term of this patent is extended or adjusted under 35 U.S.C. 154(b) by 0 days.

(21) Appl. No.: 16/124,332

(22) Filed: Sep. 7, 2018

(65) Prior Publication Data

US 2019/0296449 A1 Sep. 26, 2019

(30) Foreign Application Priority Data

Mar. 20, 2018 (JP) ..... 2018-053241

(51) Int. Cl.
*H01Q 21/00* (2006.01)
*H01Q 13/08* (2006.01)
(Continued)

(52) U.S. Cl.
CPC ..... *H01Q 21/0087* (2013.01); *H01Q 9/0414* (2013.01); *H01Q 13/08* (2013.01); *H01Q 13/106* (2013.01); *H01Q 21/065* (2013.01)

(58) Field of Classification Search
CPC .. H01Q 21/0087; H01Q 21/065; H01Q 13/08; H01Q 13/106; H01Q 9/0414
See application file for complete search history.

(56) References Cited

U.S. PATENT DOCUMENTS

2009/0015483 A1* 1/2009 Liu ..... H01Q 9/0457 343/700 MS
2015/0194730 A1* 7/2015 Sudo ..... H01Q 9/045 343/905

(Continued)

FOREIGN PATENT DOCUMENTS

JP 2018-29155 2/2018

OTHER PUBLICATIONS

Hashimoto, K. et al., "Stripline-Fed Patch Antenna with Long-Term Reliable Conductive Vias", IEICE Technical Report AP2017-73, 2017, 12 pages (with English Abstract & English Translation).

*Primary Examiner* — Hoang V Nguyen
(74) *Attorney, Agent, or Firm* — Oblon, McClelland, Maier & Neustadt, L.L.P.

(57) ABSTRACT

An antenna device according to an aspect of the present invention includes dielectric plates, a first to fourth vias, lines, a conductor plate, opening sections, and an antenna element for transmission. The first to fourth vias respectively pierce through the dielectric plates corresponding to the vias and transmit high-frequency signals. A high-frequency signal flowing in the first via is transmitted to the element via a line and an opening section. The line is provided on an upper surface of a dielectric plate and is connected to an upper end portion of the first via. The opening section is provided right above a part of the line. A high-frequency signal flowing in the second, the third, and the fourth vias is transmitted from another line. The line is provided on an upper surface of another dielectric plate and is connected to an upper end of the second via.

12 Claims, 15 Drawing Sheets

(51) Int. Cl.

| | |
|---|---|
| ***H01Q 21/06*** | (2006.01) |
| ***H01Q 13/10*** | (2006.01) |
| ***H01Q 9/04*** | (2006.01) |

(56) References Cited

U.S. PATENT DOCUMENTS

| | | | | |
|---|---|---|---|---|
| 2016/0197404 | A1* | 7/2016 | Hashimoto ..... | H01Q 9/0435<br>343/848 |
| 2017/0054217 | A1* | 2/2017 | Hashimoto ..... | H01Q 9/0457 |
| 2018/0053983 | A1 | 2/2018 | Mukai et al. | |

* cited by examiner

ANTENNA DEVICE AND ANTENNA APPARATUS

CROSS-REFERENCE TO RELATED APPLICATION(S)

This application is based upon and claims the benefit of priority from Japanese Patent Application No. 2018-053241, filed Mar. 20, 2018; the entire contents of which are incorporated herein by reference.

FIELD

Embodiments described herein relate generally to an antenna device and an antenna apparatus.

BACKGROUND

A "coaxial-stripline converter" has been proposed to transfer a high-frequency signal to a signal line configuring a stripline formed in a laminated substrate. Further, a technique for improving long-term reliability with respect to a temperature change by reducing an aspect ratio of a via used in the "coaxial-stripline converter" has been proposed. In the technique, vias conducting in a stacking direction (the up-down direction) are provided for each of dielectric substrates present between a connected coaxial connector and the stripline. Further, these vias are disposed side by side in the stacking direction. Using a plurality of vias enable an aspect ratio of the respective vias to decrease, and capacitive coupling of the vias opposed to each other enable transfer from the coaxial connector to the signal line.

It has been found that an antenna characteristic of a product which was manufactured by the proposed technique tends to fluctuate. There are many antennas have a specification according to each use of the antennas for a transmission characteristic. Therefore, there is a demand for a technique for reducing fluctuation with respect to the transmission characteristic.

DETAILED DESCRIPTION

Figure 1A:
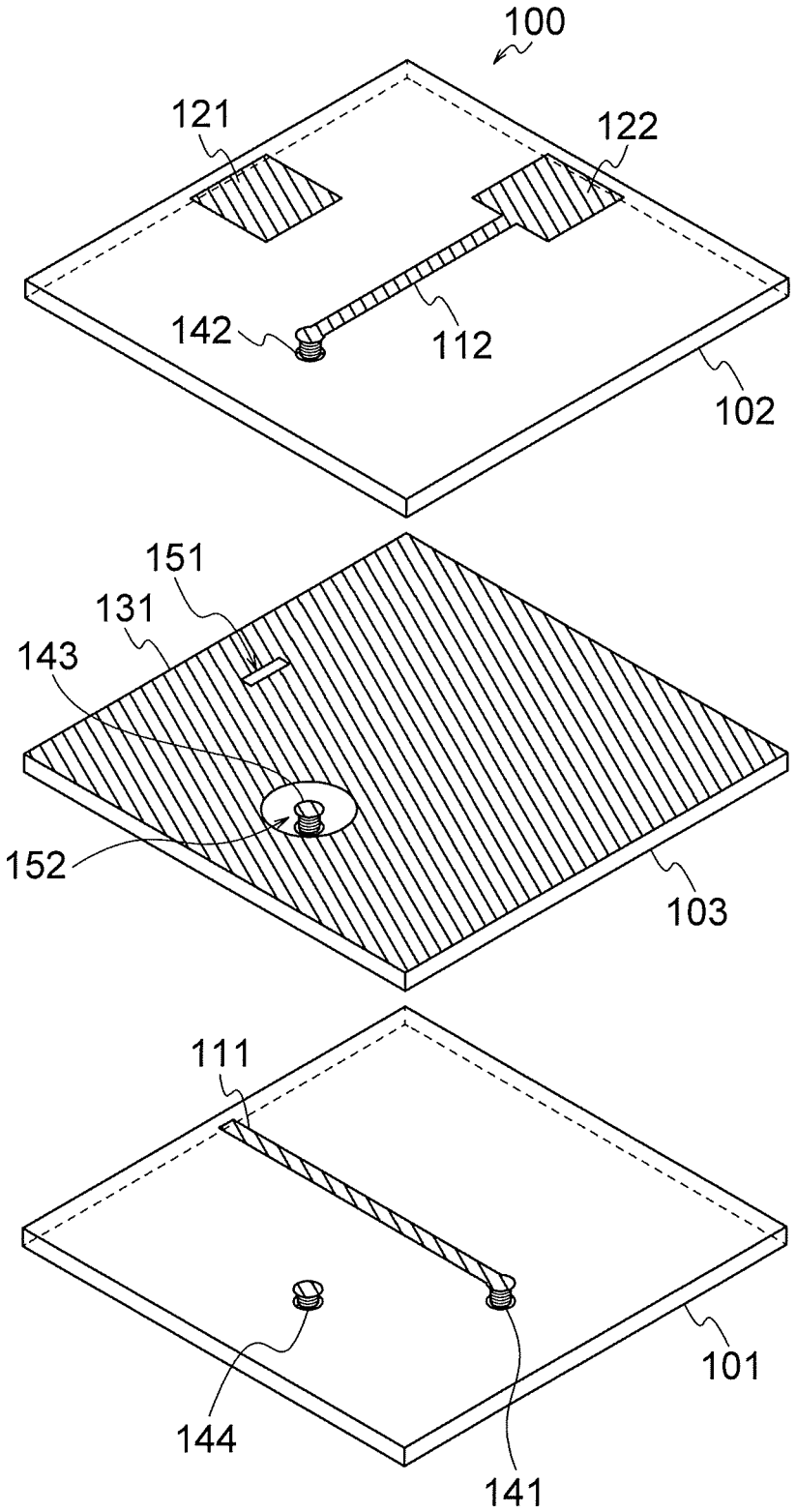
FIGS. 1A to 1D are diagrams for explaining an antenna device in a first embodiment.

An embodiment of the present invention provides an antenna, fluctuation with respect to a transmission characteristic of which is reduced.

An antenna device according to an aspect of the present invention includes a plurality of dielectric plates, a first via, a signal line for transmission, a first conductor plate, a first opening section, an antenna element for transmission, a signal line for reception, a second via, one or more third vias, a second opening section, and a fourth via. The first to fourth vias respectively pierce through the dielectric plates corresponding to the vias and transfer high-frequency signals. A first high-frequency signal flowing in the first via is transferred to the antenna element for transmission via the signal line for transmission and the first opening section. The signal line for transmission is provided on an upper surface of a first dielectric plate and is connected to an upper end portion of the first via. The first opening section is provided right above a part of the signal line for transmission and pierces through the first conductor plate. A second high-frequency signal flowing in the second via, the third via, and the fourth via is transferred from the signal line for reception. The signal line for reception is provided on an upper surface of a second dielectric plate and is connected to an upper end of the second via.

Below, a description is given of embodiments of the present invention with reference to the drawings. The present invention is not limited to the embodiments.

In the drawings, the same reference numerals and signs are attached to the same components.

First Embodiment

Figure 1B:
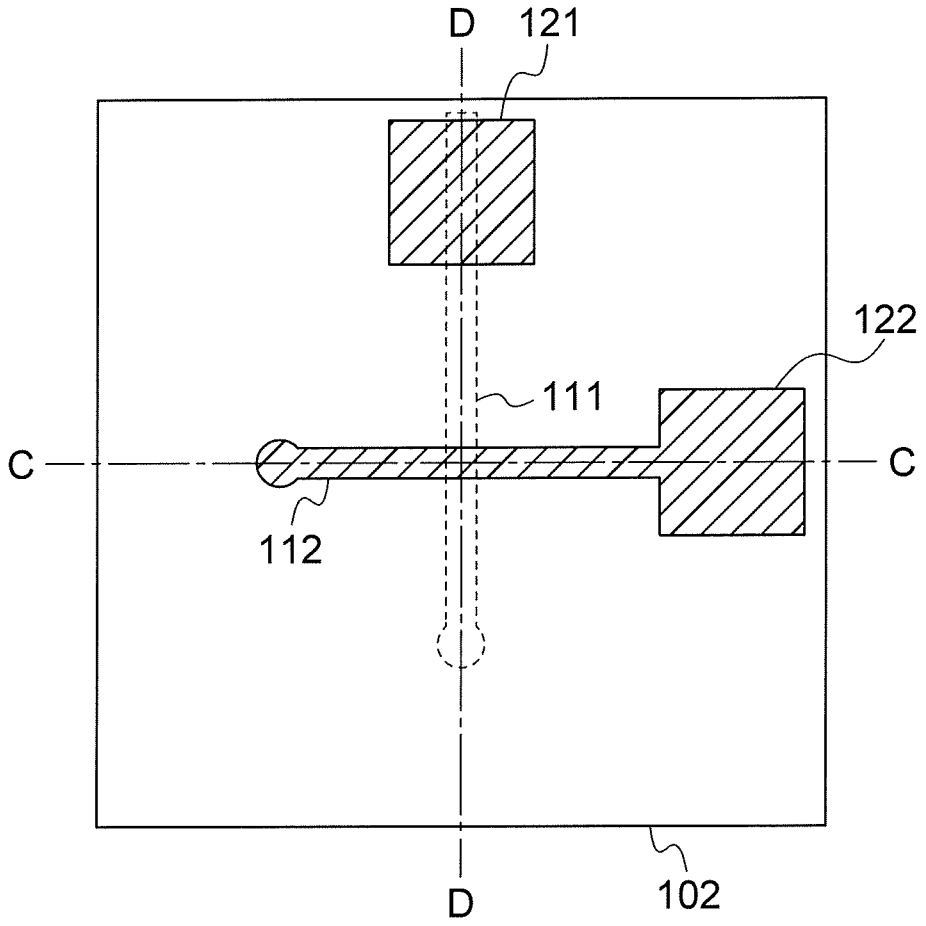
Figure 1C:
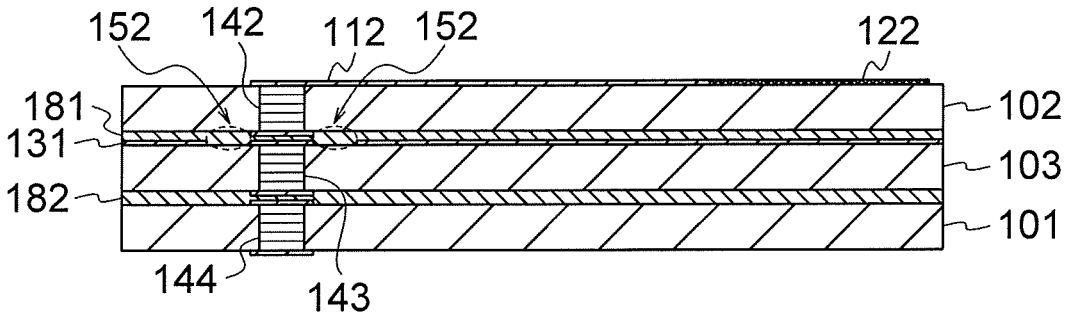
Figure 1D:
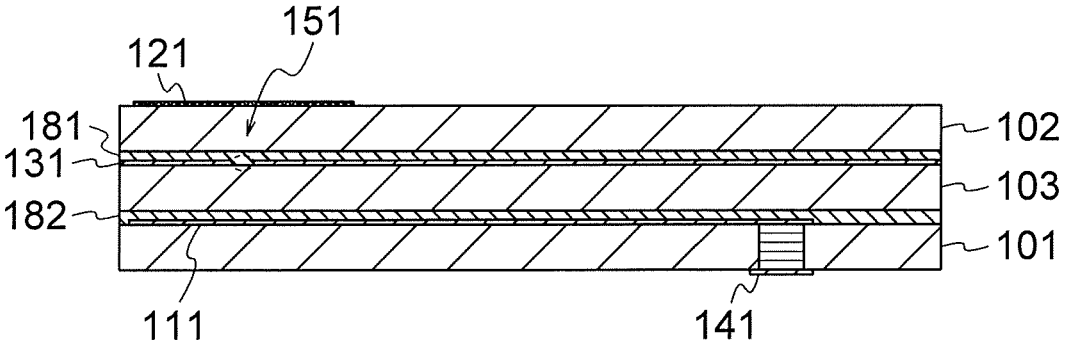

FIGS. 1A to 1D are diagrams for explaining an antenna device in a first embodiment. FIG. 1A is an exploded perspective view of an antenna device 100 in the first embodiment. FIG. 1B is a top view of the antenna device 100. FIG. 1C is a sectional view taken along a C-C line shown in FIG. 1B. The C-C line is a line extending along a signal line for reception 112 explained below. FIG. 1D is a sectional view taken along a D-D line shown in FIG. 1B. The D-D line is a line extending along a signal line for transmission 111 explained below. Incidentally, in FIG. 1A, dielectric plates are transparently shown. In FIG. 1A, adhesive layers 181 and 182 shown in FIGS. 1C and 1D are omitted. In FIG. 1B, the signal line for transmission 111 is indicated by a dotted line because the signal line for transmission 111 is actually hidden behind a second dielectric plate 102.

The antenna device 100 in the first embodiment includes a first dielectric plate (a first dielectric layer) 101, a second dielectric plate (a second dielectric layer) 102, a third dielectric plate (a third dielectric layer) 103, a signal line for transmission 111, a signal line for reception 112, an antenna element for transmission 121, an antenna element for reception 122, a first conductor plate (a first conductive layer) 131, a first via 141, a second via 142, a third via 143, and a fourth via 144. The antenna device 100 may include adhesive layers for boning the layers. In this embodiment, the antenna device 100 further includes a first adhesive layer 181 and a second adhesive layer 182.

As shown in FIGS. 1A to 1D, the first dielectric plate 101, the second dielectric plate 102, and the third dielectric plate 103 are stacked. In this explanation, a stacking direction of the dielectric plates (the thickness direction of layers) is explained as the up-down direction. A direction in which the first dielectric plate 101 is present is referred to as downward and a direction in which the second dielectric plate 102 is present is referred to as upward. The third dielectric plate 103 is sandwiched between the first dielectric plate 101 and the second dielectric plate 102 (an intermediate layer). Incidentally, for convenience of explanation, three dielectric layers are assumed. However, three or more dielectric layers may be present. For example, a fourth dielectric plate and a fifth dielectric plate may be present between the first dielectric plate 101 and the second dielectric plate 102.

In the antenna device 100 in this embodiment, input and output of high-frequency signals are assumed to be performed on the lower surface of the first dielectric plate 101, and the high-frequency signals are assumed to be input from or output to a not-shown external circuit or the like. It is also assumed that transmission and reception of the high-frequency signal using an electromagnetic wave is performed on the upper surface of the second dielectric plate 102 in the antenna device 100 in this embodiment. Therefore, a transfer path for the high-frequency signal is provided between the lower surface of the first dielectric plate 101 and the upper surface of the second dielectric plate 102. Incidentally, it is assumed that the high-frequency signal is a signal having a frequency equal to or higher than 1 GHz.

In this embodiment, the transfer path for the high-frequency signal is divided into a transmission path for transferring a high-frequency signal to be transmitted and a reception path for transferring the received high-frequency signal. Details are explained below. In the following explanation, a high-frequency signal to be transmitted is simply described as transmission signal (first high-frequency signal) and a received high-frequency signal is simply described as reception signal (second high-frequency signal).

Components of the antenna device 100 will be explained.

The dielectric plates from the first dielectric plate 101 to the third dielectric plate 103 are substrates formed of insulators. As the insulators, a resin substrate of, for example, PTFE (polytetrafluoroethylene) or epoxy may be used. Alternatively, a film of foamed plastic obtained by causing resin to foam, liquid crystal polymer, or the like may be used.

Incidentally, in FIGS. 1A and 1B, a plan view shape of the dielectric plates is a rectangle. However, the shape is not limited to the rectangle. The shape may be, for example, a polygon, a circle, or other shapes.

As shown in FIG. 1A, the signal line for transmission 111, the first via 141, and the fourth via 144 are provided on the first dielectric plate 101.

The signal line for transmission 111 is provided on the upper surface of the first dielectric plate 101. The signal line for transmission 111 is usually a conductive material film patterned on a dielectric plate surface. However, the signal line for transmission 111 may be formed by other methods.

The first via 141 is a conductive via provided to pierce through the first dielectric plate 101. A land section at the lower end of the first via 141 is exposed to the surface of the lower surface of the first dielectric plate 101. The first via 141 is connected to the signal line for transmission 111 via a land section at the upper end of the first via 141 on the upper surface of the first dielectric plate 101.

When a transmission signal is transferred to the land section at the lower end of the first via 141, the signal is transferred to the first via 141 and the signal line for transmission 111 because the land section at the upper end of the first via 141 and the signal line for transmission 111 are connected. That is, the first via 141 and the signal line for transmission 111 are parts of a transmission path for transmitting the transmission signal.

The fourth via 144 is a conductive via provided to pierce through the first dielectric plate 101. A land section at the lower end of the fourth via 144 is exposed to the surface of the lower surface of the first dielectric plate 101. Consequently, the land section at the lower end of the fourth via 144 can be electrically connected to an external circuit or the like. The land section outputs a reception signal to the external circuit or the like. That is, the fourth via 144 is a part of a reception path for receiving the reception signal.

Incidentally, the vias from the first via 141 to the fourth via 144 are formed by forming plating on the inner wall surfaces of through-holes of the dielectric plates or filling conductive resin in the through-holes.

Incidentally, land sections are formed at the upper ends and the lower ends of the vias of the first via 141 to the fourth via 144. The land sections are usually conductive material films patterned on a dielectric plate surface. However, the land sections may be formed by other methods. In FIG. 1A, the shape of the land sections is a circle. However, the shape of the land sections is not limited to the circle. The shape of the land sections may be a shape such as a rectangle or a polygon.

As shown in FIGS. 1A and 1B, the antenna element for transmission 121, the antenna element for reception 122, the signal line for reception 112, and the second via 142 are provided on the second dielectric plate 102.

In this embodiment, the antenna element for transmission 121 and the antenna element for reception 122 are provided on the upper surface of the second dielectric plate 102. The antenna element for transmission 121 and the antenna element for reception 122 are conductive patches formed of a conductive material such as metal. The antenna element for transmission 121 and the antenna element for reception 122 are formed such that the plan view shape of the antenna element for transmission 121 and the antenna element for reception 122 is a rectangle (e.g., a square) shown in FIG. 1B.

The antenna element for transmission 121 receives the transmission signal and radiates the transmission signal with an electromagnetic wave. That is, the transmission signal transferred to the first via 141 is transferred to the antenna element for transmission 121.

As shown in FIGS. 1A and 1B, the antenna element for transmission 121 is disposed to be located right above a part of the signal line for transmission 111. As shown in FIG. 1B, a region where the antenna element for transmission 121 and the signal line for transmission 111 overlap only has to be present in a plan view.

The antenna element for reception 122 generates a reception signal with the electromagnetic wave. That is, the reception signal transferred to the fourth via 144 is the reception signal transferred from the antenna element for reception 122.

The signal line for reception 112 is provided on the upper surface of the second dielectric plate 102. One end of the signal line for reception 112 is connected to the antenna element for reception 122. The signal line for reception 112 is usually a conductive material film patterned on a dielectric plate surface. However, the signal line for reception 112 may be formed by other methods.

The second via 142 is a conductive via provided to pierce through the second dielectric plate 102. A land section at the upper end of the second via 142 is connected to one end not connected to the antenna element for reception 122 of the signal line for reception 112 on the upper surface of the second dielectric plate 102. The second via 142 is provided to be located right above the fourth via 144.

Since the antenna element for reception 122, the signal line for reception 112, and the second via 142 are connected, the reception signal is transferred from the antenna element for reception 122 to the signal line for reception 112 and the second via 142. That is, the signal line for reception 112 and the second via 142 are parts of a reception path for receiving the reception signal.

As shown in FIG. 1A, the first conductor plate 131 and the third via 143 are provided on the third dielectric plate 103.

At least a first opening section (a slot for transmission) 151 and a second opening section 152 are provided in the first conductor plate 131.

The first conductor plate 131 is provided between the second dielectric plate 102 and the third dielectric plate 103. A method of forming the first conductor plate 131 is not particularly limited. In FIG. 1A, the first conductor plate 131 is illustrated as a conductive material film patterned on the upper surface of the third dielectric plate 103. However, the first conductor plate 131 may be a conductive material film patterned on the lower surface of the second dielectric plate 102. Alternatively, the first conductor plate 131 may be an independent conductor plate provided between the second dielectric plate 102 and the third dielectric plate 103.

The first opening section (the slot for transmission) 151 is provided between the signal line for transmission 111 and the antenna element for transmission 121. In FIG. 1A, the shape of the first opening section 151 is a rectangle. However, the shape of the first opening section 151 is not limited to the rectangle. The shape of the first opening section 151 may be a shape such as an H shape, a dumbbell shape, an ellipse, or a circle.

The second opening section 152 is provided around the third via 143 for insulation such that the third via 143 does not come into contact with the first conductor plate 131. That is, the second opening section 152 includes the third via 143 on the inner side. Incidentally, the shape of the second opening section 152 is a circle in FIG. 1A, but the shape of the second opening section 152 is not particularly limited. The shape of the second opening section 152 may be a shape such as a rectangle or a polygon.

The first conductor plate 131 configures a microstrip line for transmission in conjunction with the signal line for transmission 111 according to the disposition of the first conductor plate 131. When a transmission signal is transferred to the signal line for transmission 111 through the first via 141, the signal line for transmission 111 is electromagnetically coupled to the antenna element for transmission 121 on the upper surface of the second dielectric plate 102 by the microstrip line for transmission. The first conductor plate 131 that prevents the electromagnetic coupling is present between the signal line for transmission 111 and the antenna element for transmission 121. However, since the first opening section 151 is present right above a part of the signal line for transmission 111, the signal line for transmission 111 and the antenna element for transmission 121 can be electromagnetically coupled in the part. Consequently, the transmission signal is transferred from the signal line for transmission 111 to the antenna element for transmission 121. Thus, the antenna element for transmission 121 operates as a patch antenna which is fed with power by slot coupling feeding.

The first conductor plate 131 configures a microstrip line for reception in conjunction with the signal line for reception 112 according to the disposition of the first conductor plate 131. As described above, the signal line for reception 112 is connected to the antenna element for reception 122. Therefore, the antenna element for reception 122 operates as a patch antenna which is fed with power from the microstrip line for reception by coplanar feeding.

The third via 143 is a conductive via provided to pierce through the third dielectric plate 103. The third via 143 is provided right above the fourth via 144 and right under the second via 142. In other words, the second via 142, the third via 143, and the fourth via 144 are disposed side by side on the same axis with respect to the stacking direction.

The third via 143 is not directly connected to the second via 142 and the fourth via 144 because of adhesive layers, gaps, or the like. Therefore, a direct current does not flow between the second via 142 and the fourth via 144 through the third via 143.

A land section at the upper end of the third via 143 and a land section at the lower end of the second via 142 are opposed to each other at a distance sufficiently short for capacitively coupling the second via 142 and the third via 143. A land section at the lower end of the third via 143 and a land section at the upper end of the fourth via 144 are opposed to each other at a distance sufficiently short for capacitively coupling the third via 143 and the fourth via 144. Therefore, a high-frequency current can flow between the second via 142 and the fourth via 144 according to the capacitive coupling of the second via 142 and the third via 143 and the capacitive coupling of the third via 143 and the fourth via 144. That is, the reception signal, which is the high-frequency signal, is transferred from the second via 142 to the fourth via 144 through the third via 143. Therefore, the third via 143 forms a part of a reception path.

Although not shown in FIG. 1A, in the antenna device 100, adhesive layers may be provided among the dielectric plates to bond the dielectric plates as shown in FIG. 1C. The adhesive layers may be formed by films of, for example, thermoplastic resin or thermosetting resin. Alternatively, they may be formed by prepregs. Incidentally, when the adhesive layers are provided, the distance in a stacking direction of the components does not fluctuate in each of a plurality of antenna devices 100. As a result, an antenna characteristic is prevented from fluctuating in each of the plurality of antenna devices 100. Therefore, the adhesive layers are preferably provided.

Incidentally, the adhesive layers are pressed in a heated state in a vacuum environment (referred to as decompressed environment as well) in a press process for stacking. Consequently, the dielectric plates are bonded by the adhesive layers. However, in the press process, it would be possible that the adhesive layer remains between the opposed vias (e.g., between the fourth via 144 and the third via 143) in some cases and the adhesive layer does not remain in other cases. For example, the adhesive layers are often broken by the land sections of the vias. In this embodiment, it is assumed that the vias of the adjacent layers are electrically connected by the capacitive coupling. Even in the case unlike design specifications that the adhesive layers do not remain and a part of the vias are in contact, no problem occurs in this embodiment because the high-frequency current can flow in the case.

First, operation during reception of the antenna device 100 is explained with reference to FIG. 1C. First, a reception signal is received by the antenna element for reception 122 on the upper surface of the second dielectric plate 102. The reception signal is transferred to the signal line for reception 112 connected to the antenna element for reception 122 and the second via 142 connected to the signal line for reception 112.

The reception signal transferred to the second via 142 is transferred to the third via 143 by capacitive coupling of the second via 142 and the third via 143. The reception signal transferred to the third via 143 is transferred to the fourth via 144 by the capacitive coupling of the third via 143 and the fourth via 144.

Thus, the reception signal is transferred from the upper surface of the second dielectric plate 102 to the lower surface of the first dielectric plate 101 by the vias through the stacked layers. If a transfer line or the like is connected to the land section at the lower end of the fourth via 144, the reception signal can be output to a destination, e.g. a circuit, connected by the transfer line.

The transfer of the reception signal from the upper surface of the second dielectric plate 102 to the lower surface of the first dielectric plate 101 is realized by the second via 142, the third via 143, and the fourth via 144 rather than being realized by one via. Thereby, aspect ratios of the respective vias are further reduced. Consequently, long-term reliability with respect to a temperate change is further improved than when the transfer of the reception signal is realized by one via.

When there are four or more layers of dielectric plates, a via such as the third via 143 only has to be provided for each of stacked layers to pass the reception signal from an upper layer to a lower layer.

Operation during transmission of the antenna device 100 is explained with reference to FIG. 1D. First, a transmission signal is input to the land section at the lower end of the first via 141 on the lower surface of the first dielectric plate 101. The transmission signal is transferred to the signal line for transmission 111 connected to the first via 141. The signal line for transmission 111 and the antenna element for transmission 121 on the upper surface of the second dielectric plate 102 are electromagnetically coupled. Therefore, the transmission signal is transferred to the antenna element for transmission 121.

Thus, the transmission signal is transferred from the lower surface of the first dielectric plate 101 to the upper surface of the second dielectric plate 102 not through the capacitively coupled vias. The antenna element for transmission 121 radiates the transmission signal to an external space using an electromagnetic wave. Therefore, the transmission signal is not affected by the capacitive coupling, because the transmission signal is not transferred through the capacitively coupled vias.

Capacitance of the capacitive coupling depends on the positions of the vias, the distances among the vias, and the like. The positions and the distances fluctuate in each of products because of a lot of factors. Therefore, it is relatively difficult to match the capacitance with design specifications. For example, the fluctuation of the capacitance is cause by manufacturing fluctuation of the dielectric plates, the adhesive layers, or the like; and fluctuation of the conductor lands with respect to the film thickness. Pressure, temperature, and the like in the press process also cause the fluctuation of the capacitance. That is, when the transfer is performed through the capacitively coupled vias, an antenna characteristic fluctuates in each of products.

However, in the antenna device 100 in the first embodiment, the transmission signal is not transferred through the capacitively coupled vias. Therefore, the transmission characteristic is prevented from fluctuating.

Incidentally, when there are four or more layers of dielectric plates, the transmission signal is transferred from the signal line for transmission 111 to the antenna element for transmission 121 by electromagnetic coupling.

As described above, according to this embodiment, the transmission signal is transferred from the signal line for transmission 111 to the antenna element for transmission 121 not through the capacitively coupled vias. Consequently, the transmission characteristic of the antenna device 100 does not fluctuate depending on a product and stabilizes even when the antenna device 100 includes the coaxial-stripline converter.

Second Embodiment

FIGS. 2A to 2D are diagrams for explaining an antenna device in a second embodiment. As in the first embodiment, in FIGS. 2A to 2D, an exploded perspective view, a top view, a C-C line sectional view, and a D-D line sectional view are shown. Incidentally, a coaxial connector is connected as an input and output interface of the antenna device 100 in FIGS. 2C and 2D. Incidentally, explanation about similarities to the first embodiment is omitted.

The antenna device 100 in the second embodiment is different from the antenna device 100 in the first embodiment in that the antenna device 100 in the second embodiment further includes a second conductor plate 132 in order to improve a transmission characteristic. At least a third opening section 153 and a fourth opening section 154 are provided in the second conductor plate 132.

Figure 2A:
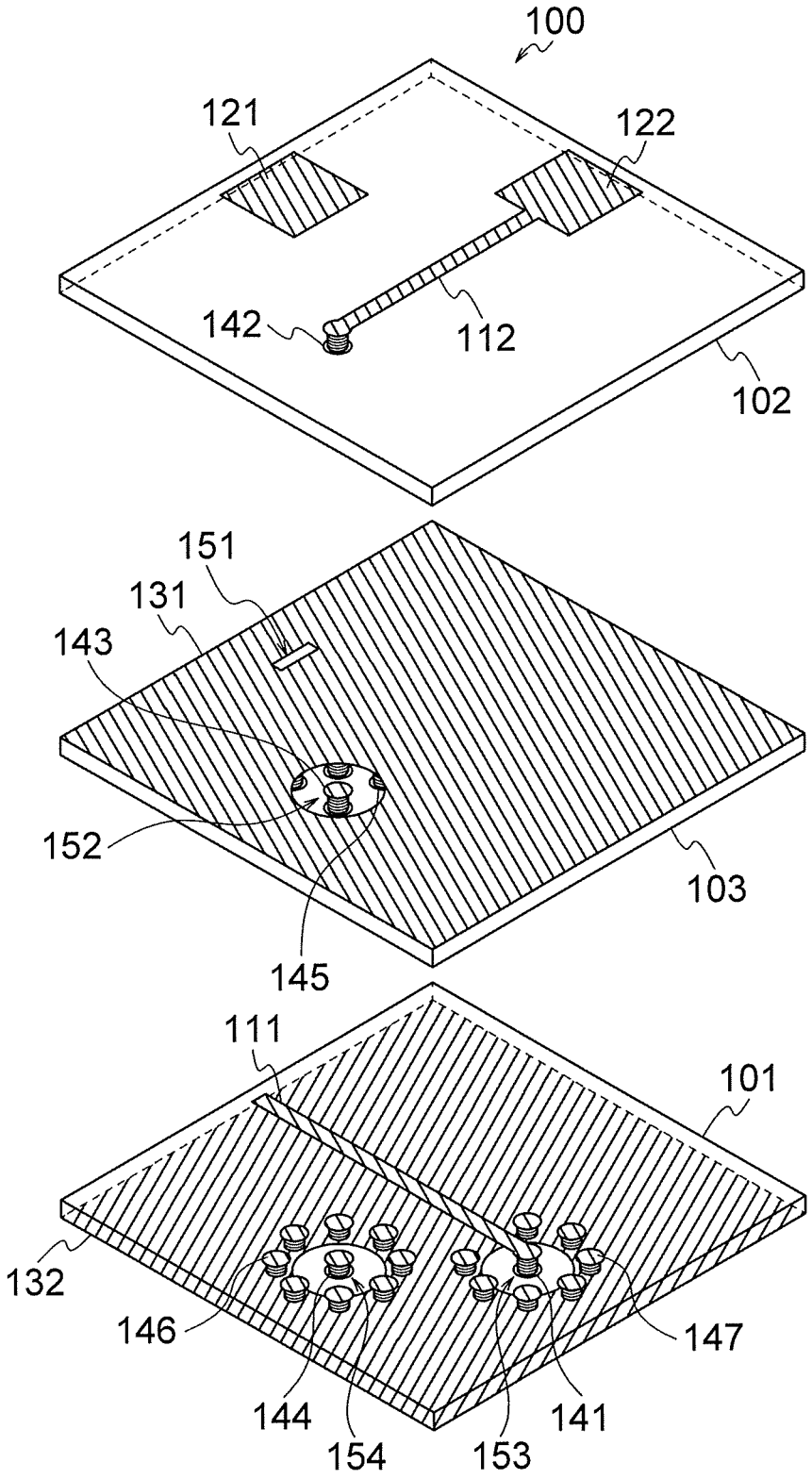
FIGS. 2A to 2D are diagrams for explaining an antenna device in a second embodiment.
Figure 2B:
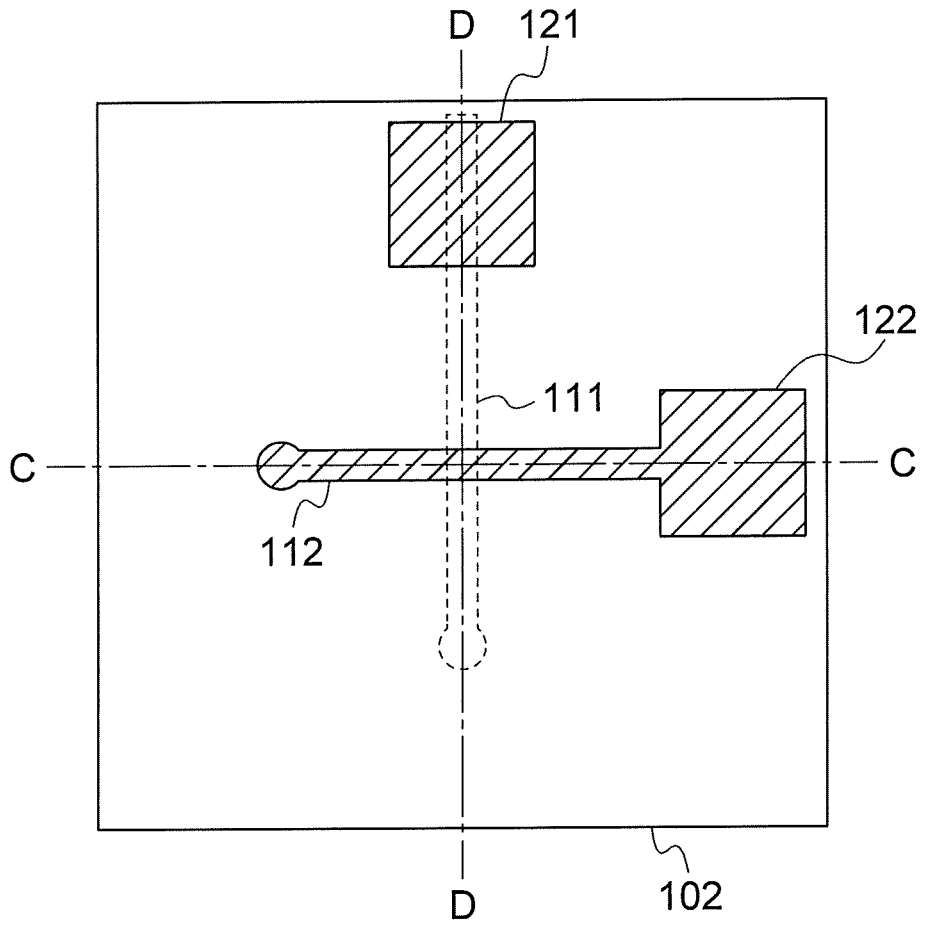

The second conductor plate 132 is provided further on the lower side than the first dielectric plate 101. Therefore, the second conductor plate 132 prevents unnecessary radiation further to the lower side than the first dielectric plate 101. Consequently, a transmission characteristic of an antenna can be further improved. Incidentally, a method of forming the second conductor plate 132 is not particularly limited as well as the first conductor plate 131. In FIG. 2A, the second conductor plate 132 is illustrated as a conductive material film patterned on the lower surface of the first dielectric plate 101. However, the second conductor plate 132 may be an independent conductor plate. The second conductor plate 132 may be present on the upper surface or the lower surface of a dielectric plate of a layer lower than the first dielectric plate 101.

The third opening section 153 and the fourth opening section 154 are respectively provided for insulation around the first via 141 and the fourth via 144 such that the first via 141 and the fourth via 144 do not come into contact with the second conductor plate 132. That is, the third opening section 153 includes the first via 141 on the inner side and the fourth opening section 154 includes the fourth via 144 on the inner side. The shape of the third opening section 153 and the fourth opening section 154 is not particularly limited as well as the second opening section 152.

Since the second conductor plate 132 is disposed to sandwich the signal line for transmission 111 in the stacking direction in conjunction with the first conductor plate 131, the second conductor plate 132 configures a stripline for transmission. Like the microstrip line for transmission in the first embodiment, the stripline for transmission in the second embodiment electromagnetically couples the signal line for transmission 111 and the antenna element for transmission 121. Consequently, a transmission signal in the signal line for transmission 111 is transferred to the antenna element for transmission 121 as in the first embodiment. The antenna element for transmission 121 operates as a slot coupling feeding type patch antenna. Therefore, the transmission signal is transferred not through the capacitively coupled vias, and the transmission characteristic is not affected by the capacitive coupling, as in the first embodiment.

The second embodiment is different from the first embodiment in that new vias are further provided to surround the periphery of the vias present between the first conductor plate 131 and the second conductor plate 132. Incidentally, the new vias may be formed in the same manner as the first to fourth vias.

As described above, the stripline is used in the second embodiment. During transmission, it is likely that an unnecessary parallel plate mode by the stripline is propagated in parallel plates (i.e., the first conductor plate 131 and the second conductor plate 132) and affects the vias present in the parallel plates. During reception as well, an unnecessary parallel plate mode is propagated in the parallel plates and affects the vias present in the parallel plates because the first conductor plate 131 configures the microstrip line for reception.

Therefore, it is preferable to further provide new vias around the vias present between the parallel plates to thereby form a pseudo coaxial structure and prevent the influence of the parallel plate mode.

To form the pseudo coaxial structure, first, new vias are provided for each of dielectric plates present between two parallel plates in order to electrically connect the two parallel plates. In this explanation, a set including, as components, the new vias provided for each of the dielectric plates is described as via set. The new vias, which are the components of the via set, are respectively disposed side by side in the stacking direction. The new vias are electrically connected by capacitive coupling. The parallel plates and the new vias may be directly connected or may be electrically connected by the capacitive coupling. New vias directly connected by, for example, fracture of an adhesive layer may be present.

A plurality of via sets are disposed to surround target vias protected from the influence of the parallel plate mode. That is, the plurality of via sets are disposed on an arc centering on a via that is present between the parallel plates and transfers a high-frequency signal. Thus, a pseudo coaxial structure in which the protection target corresponds to an inner conductor and the via sets corresponds to an outer conductor is formed. Incidentally, the pseudo coaxial structure does not always have to be formed for all vias that are present between the parallel plates and transfer the high-frequency signal.

Figure 2C:
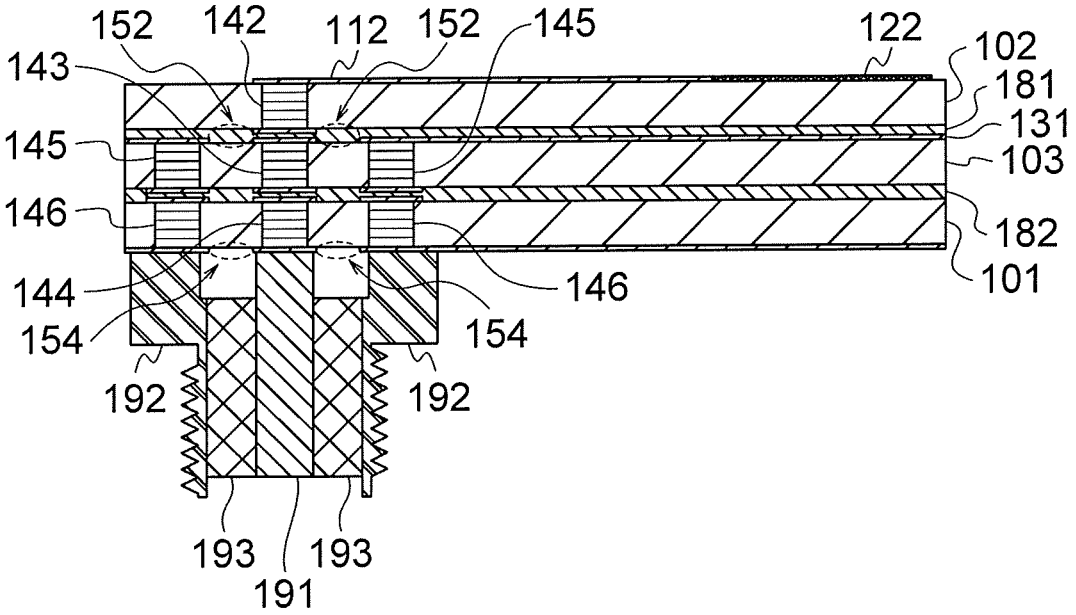

The pseudo coaxial structure in this embodiment is specifically explained. On a reception path side, the third via 143 and the fourth via 144 are present between the parallel plates as shown in FIG. 2C. Therefore, new vias are shown on an arc centering on the third via 143 and the fourth via 144. A plurality of vias surrounding the third via 143 are described as fifth vias 145 and a plurality of vias surrounding the fourth via 144 are described as sixth vias 146.

The fifth vias 145 pierce through the third dielectric plate 103 and are connected to the first conductor plate 131 in land sections at upper ends. The sixth vias 146 pierce through the first dielectric plate 101 and are connected to the second conductor plate 132 in land sections at lower ends. The sixth vias 146 are opposed to any ones of the fifth vias 145 in the stacking direction. That is, a plurality of via sets of the fifth vias 145 and the sixth vias 146 disposed side by side in the stacking direction are present. The third via 143 and the fourth via 144 are surrounded by the plurality of via sets. Consequently, a pseudo coaxial structure is formed. The third via 143 and the fourth via 144 correspond to an inner conductor of the structure, and the via sets of the fifth vias 145 and the sixth vias 146 correspond to an outer conductor of the structure.

Figure 2D:
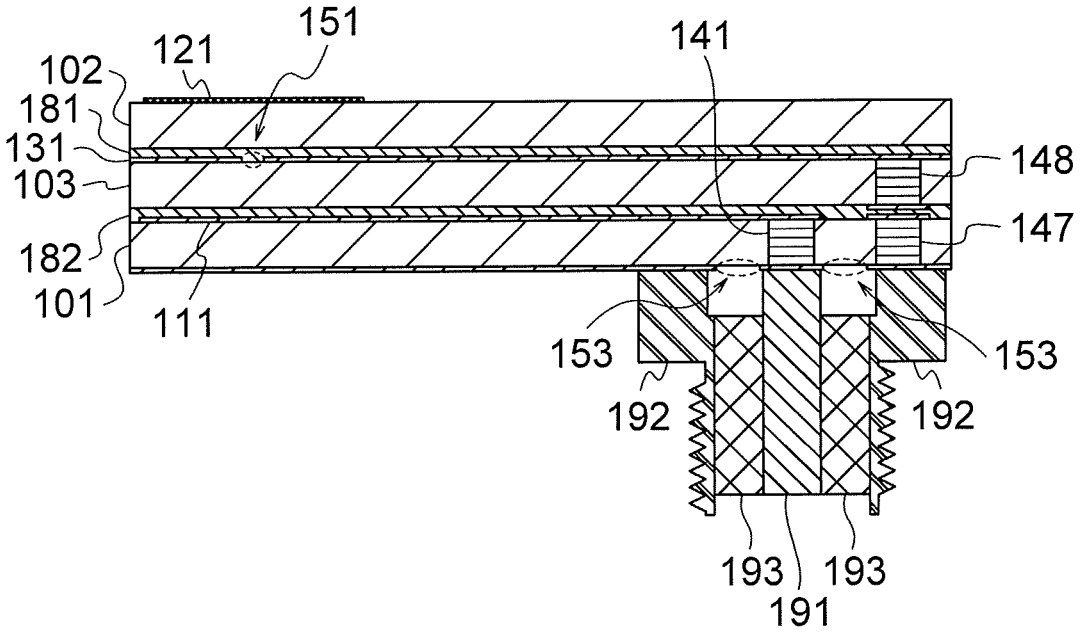

On the transmission path side, the first via 141 is present between the parallel plates as shown in FIG. 2D. Therefore, new vias are shown on an arc centering on the first via 141. A plurality of vias surrounding the first via 141 are described as seventh vias 147. The seventh vias 147 pierce through the first dielectric plate 101 and are connected to the second conductor plate 132 in land sections at lower ends.

In FIG. 2D, new vias provided to be opposed to each of the seventh vias 147 in the stacking direction are shown. A plurality of vias opposed to each of the seventh vias 147 are described as eighth vias 148. The eighth vias 148 pierce through the third dielectric plate 103 and are connected to the first conductor plate 131 in land sections at upper ends.

The number and the interval of the plurality of via sets may be adjusted as appropriate. As shown in FIG. 2A, eight via sets (sets of the fifth vias 145 and the sixth vias 146) surrounding the third via 143 and the fourth via 144 are provided. On the other hand, seven via sets (sets of the seventh vias 147 and the eighth vias 148) surrounding the first via 141 are provided not to come into contact with the signal line for transmission 111. In FIG. 2A, only one of signs attached to new views surrounding a target via is shown. The other sings are omitted. The same applies to the figures referred to below.

Thus, a pseudo coaxial structure in which the first via 141 corresponds to an inner conductor and the via sets of the seventh vias 147 and the eighth vias 148 correspond to an outer conductor is formed. Consequently, the influence of the parallel plate mode can be prevented.

Since the second conductor plate 132 is provided further on the lower side than the first dielectric plate 101, it is easy to use a coaxial connector as the input and output interface of the antenna device 100 in the second embodiment, as shown in FIGS. 2C and 2D.

The coaxial connector is configured from an inner conductor 191 and an outer conductor 192. Incidentally, an insulator 193 may be provided between the inner conductor 191 and the outer conductor 192. The coaxial connector is mounted on the antenna device 100 such that the inner conductor 191 of the coaxial connector is connected to the inner conductor of the pseudo coaxial structure and the outer conductor 192 of the coaxial connector is connected to the second conductor plate 132 on the lower surface of the first dielectric plate 101. That is, in a coaxial connector for transmission, the inner conductor 191 is connected to the first via 141 and the outer conductor 192 is connected to the second conductor plate 132. In a coaxial connector for reception, the inner conductor 191 is connected to the fourth via 144 and the outer conductor 192 is connected to the second conductor plate 132. Consequently, the inner conductor 191 can be connected to a reception path or a transmission path and the outer conductor 192 can be connected to a reference voltage.

Incidentally, a method of mounting the coaxial connector is not particularly limited. In general, the coaxial connector is mounted by soldering, screwing, or the like. However, the coaxial connector may be mounted by other methods. The coaxial connector may be mounted by combining several methods in order to improve reliability of the mounting.

As described above, according to this embodiment, unnecessary radiation toward the lower side of the antenna device 100 can be prevented by the second conductor plate 132. The transmission characteristic can be further improved than in the first embodiment. Since the second conductor plate 132 is provided, the influence of the parallel plate mode that occurs in the first conductor plate 131 and the second conductor plate 132 can be prevented by forming the pseudo coaxial structure. Since the second conductor plate 132 is provided, it is easy to use the coaxial connector as the input and output interface.

Third Embodiment

FIGS. 3A to 3D are diagrams for explaining an antenna device in a third embodiment. As in the embodiments explained above, an exploded perspective view, a top view, a C-C line sectional view, and a D-D line sectional view are shown in FIGS. 3A to 3D. Incidentally, explanation about similarities to the embodiments explained above is omitted.

Incidentally, it is described above that the first conductor plate 131 only has to be present between the second dielectric plate 102 and the third dielectric plate 103. As an example of the first conductor plate 131, in the third embodiment, unlike the embodiments explained above, the first conductor plate 131 is provided on the lower surface of the second dielectric plate 102.

The antenna device 100 in the third embodiment is different from the antenna device 100 in the embodiments explained above in that the antenna device 100 in the third embodiment further includes a fourth dielectric plate 104, a third conductor plate 133, and a third adhesive layer 183. In FIG. 3, new components are added to the second embodiment. However, new components may be added to the first embodiment.

In the second embodiment, the unnecessary radiation from the antenna device 100 toward the lower side is prevented. In the third embodiment, unnecessary radiation toward the upper side of the antenna device 100 is prevented. However, transmission and reception of radio waves is performed on the upper side of the antenna device 100 (i.e., the upper surface of the second dielectric plate 102). Therefore, the transmission and reception of radio waves is hindered when a conductor plate is simply provided further on the upper side than the second dielectric plate 102 as in the second embodiment.

Therefore, in the third embodiment, the fourth dielectric plate 104 and the third conductor plate 133 are provided above the second dielectric plate 102. While the third conductor plate 133 prevents the unnecessary radiation toward the upper side of the antenna device 100, a transmission signal and a reception signal are transmitted and received using an electromagnetic wave on the upper surface of the third conductor plate 133.

The fourth dielectric plate 104 is provided further on the upper side than the second dielectric plate 102. The fourth dielectric plate 104 may be formed in the same manner as the first to fourth dielectric plates. The third adhesive layer 183 that bonds the fourth dielectric plate 104 and the second dielectric plate 102 is the same as the other adhesive layers.

Figure 3A:
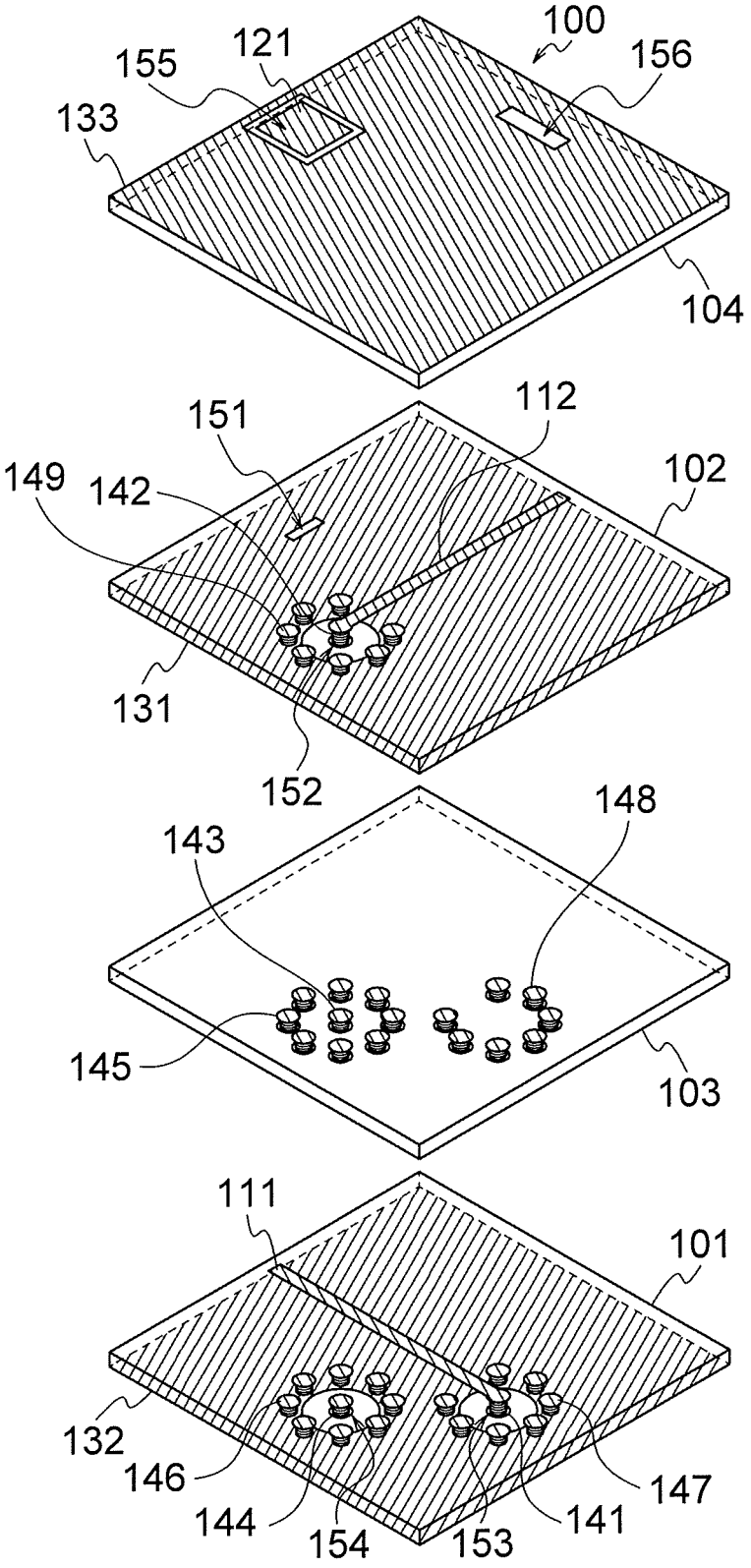
FIGS. 3A to 3D are diagrams for explaining an antenna device in a third embodiment.

The third conductor plate 133 is provided further on the upper side than the fourth dielectric plate 104. Consequently, the third conductor plate 133 prevents unnecessary radiation toward the upper side of the fourth dielectric plate 104. Like the first conductor plate 131, a method of forming the third conductor plate 133 is not particularly limited. In FIG. 3A, the third conductor plate 133 is shown as a conductive material film patterned on the upper surface of the fourth dielectric plate 104. However, the third conductor plate 133 may be an independent conductor plate.

The third conductor plate 133 includes a fifth opening section 155 and a sixth opening section (a slot for reception) 156. The antenna element for transmission 121 is disposed on the inner side of the fifth opening section 155. The fifth opening section 155 is provided for insulation such that the antenna element for transmission 121 and the third conductor plate 133 do not come into contact with each other.

Figure 3B:
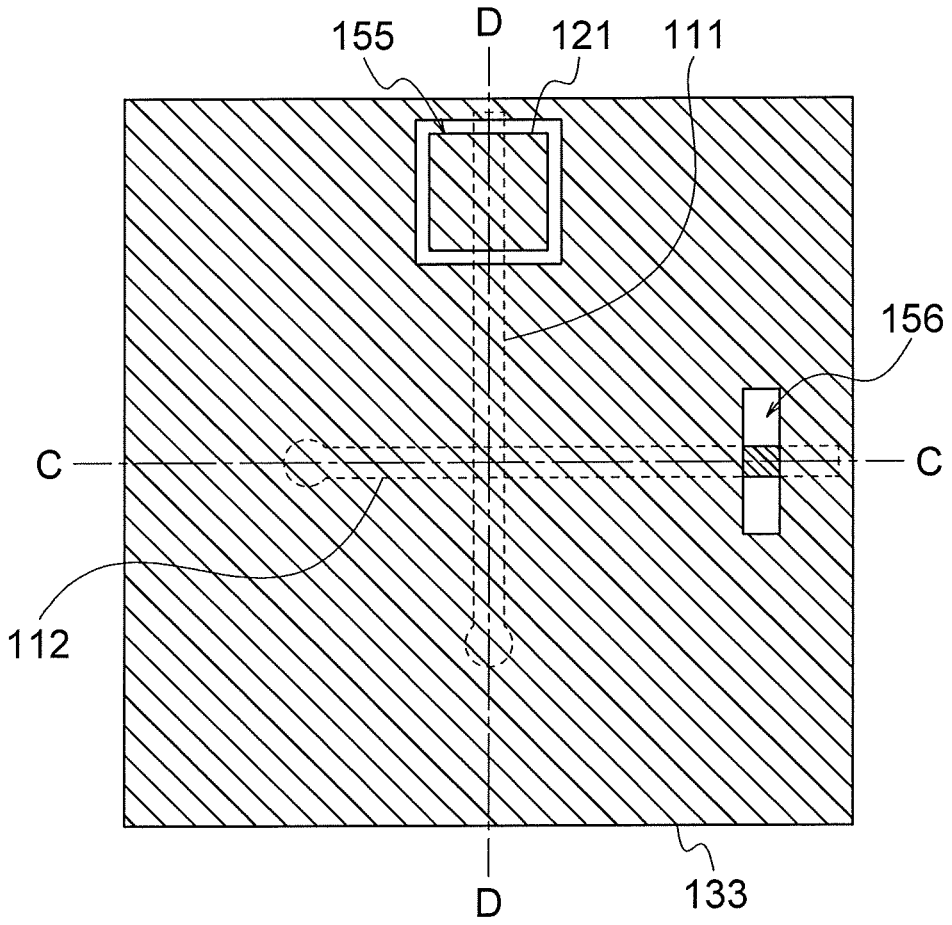

The antenna element for transmission 121 is provided on the upper surface of the second dielectric plate 102 in the embodiments explained above. In this embodiment, the antenna element for transmission 121 is however provided on the inner side of the fifth opening section 155 on the upper surface of the fourth dielectric plate 104. As shown in FIG. 3B, the position of the antenna element for transmission 121 (the position on the upper surface of the fourth dielectric plate 104) in the top view is the same as the position in the embodiments explained above. That is, the antenna element for transmission 121 is disposed right above a part of the signal line for transmission 111 as in the embodiments explained above.

Incidentally, it is assumed here that the antenna element for transmission 121 is provided on the inner side of the fifth opening section 155 later. However, a gap only has to be provided such that the antenna element for transmission 121 and the third conductor plate 133 do not come into contact with each other for the last time. For example, a groove may be provided in one conductor plate to separate the conductor plate into the antenna element for transmission 121 and the third conductor plate 133. In this case, the groove is formed as the fifth opening section 155.

In this embodiment as in the embodiments explained above, the signal line for transmission 111 and the antenna element for transmission 121 are electromagnetically coupled by a microstrip line for transmission (when the second conductor plate 132 is absent) or a stripline for transmission (when the second conductor plate 132 is present). Thereby, a transmission signal from the signal line for transmission 111 is transferred to the antenna element for transmission 121 in this embodiment. Consequently, the antenna element for transmission 121 operates as a slot coupling feeding type patch antenna as in the embodiments explained above, and can transmit the transmission signal using an electromagnetic wave.

The sixth opening section (the slot for reception) 156 is provided instead of the antenna element for reception 122. That is, the antenna element for reception 122 is absent in this embodiment. Incidentally, the signal line for reception 112 is provided on the upper surface of the second dielectric plate 102 as in the embodiments explained above. As shown in FIGS. 3A and 3B, the sixth opening section 156 is disposed to be located right above a part of the signal line for reception 112. In FIGS. 3A and 3B, the shape of the sixth opening section 156 is a rectangle. However, the shape of the sixth opening section 156 is not limited to the rectangle. The shape of the sixth opening section 156 may be a shape such as an H shape, a dumbbell shape, an ellipse, or a circle.

The third conductor plate 133 is disposed to sandwich the signal line for reception 112 in the up-down direction in conjunction with the first conductor plate 131. Therefore, the third conductor plate 133 configures a stripline for reception. Thereby, the sixth opening section 156 operates as a slot antenna. Therefore, a reception signal is transferred to the signal line for reception 112 by the sixth opening section 156 even though the antenna element for reception 122 is absent. Therefore, the reception signal can be received as in the embodiments explained above.

Thus, the transmission path and the reception path are partially changed in the third embodiment. However, transmission and reception can be performed as in the embodiments explained above. The third embodiment is the same as the embodiments explained above in that the transmission signal is transferred from the signal line for transmission 111 to the antenna element for transmission 121 not through the capacitively coupled vias. Therefore, a transmission characteristic of an antenna can be stabilized.

In this embodiment as in the second embodiment, an unnecessary parallel plate mode is propagated in parallel plates because the stripline is used. Therefore, it is preferable to further provide new vias around vias present between parallel plates as in the second embodiment to thereby form a pseudo coaxial structure and prevent the influence of the parallel plate mode. Also, it is easy to use a coaxial connector by using the pseudo coaxial structure as in the second embodiment.

Figure 3C:
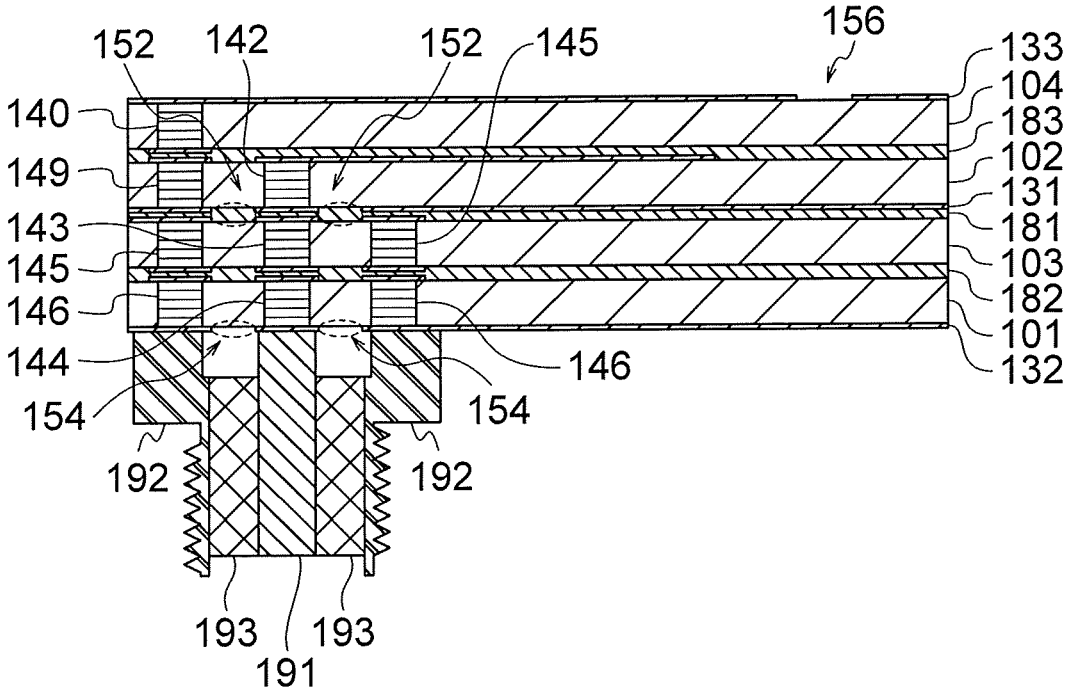
Figure 3D:
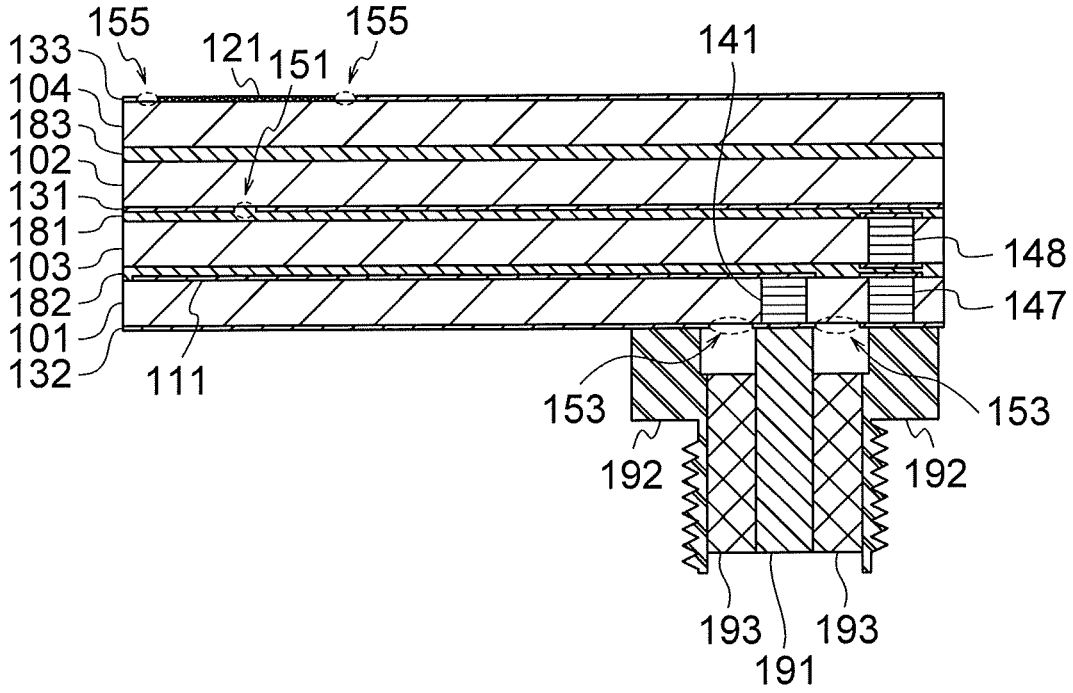

On the transmission path side, a via set of the seventh vias 147 and the eighth vias 148 surrounds the periphery of the first via 141 as shown in FIGS. 3A and 3D, as in the second embodiment. Incidentally, an example is shown in FIG. 3C in which the first conductor plate 131 is provided on the lower surface of the second dielectric plate 102. Therefore, the eighth vias 148 are not directly connected to the first conductor plate 131 and are capacitively coupled. However, the pseudo coaxial structure can be formed to prevent the influence of the parallel plate mode even in this case.

On the reception path side, the third via 143 and the fourth via 144 are surrounded by the via sets of the fifth vias 145 and the sixth vias 146 as shown in FIGS. 3A to 3C, as in the second embodiment. Further, the second via 142 is also present in the parallel plates (the first conductor plate 131 and the third conductor plate 133) in this embodiment because the third conductor plate 133 is provided. Therefore, a new via set is further provided for the second via 142 as shown in FIGS. 3A and 3C.

A plurality of vias surrounding the second via 142 is described as ninth vias 149. The ninth vias 149 pierce through the second dielectric plate 102 and are connected to the first conductor plate 131 in land sections at lower ends. In FIG. 3D, new vias provided to be opposed to the respective ninth vias 149 in the stacking direction are shown. A plurality of vias opposed to the respective ninth vias 149 are described as tenth vias 140. The tenth vias 140 pierce through the fourth dielectric plate 104 and are connected to the third conductor plate 133 in land sections at upper ends. Consequently, a pseudo coaxial structure in which the second via 142 corresponds to an inner conductor and a via set of the ninth vias 149 and the tenth vias 140 corresponds to an outer conductor is formed. Incidentally, the ninth vias 149 and the tenth vias 140 may be formed in the same manner as the first via 141 to the eighth vias 148.

As described above, according to this embodiment, unnecessary radiation toward the upper side of the antenna device 100 can be prevented by the third conductor plate 133. The transmission characteristic can be further improved than in the second embodiment.

Fourth Embodiment

FIGS. 4A to 4D are diagrams for explaining an antenna device in a fourth embodiment. As in the embodiments explained above, an exploded perspective view, a top view, a C-C line sectional view, and a D-D line sectional view are shown in FIGS. 4A to 4D. Incidentally, explanation about similarities to the embodiments explained above is omitted.

The fourth embodiment is a modification of the third embodiment. In the third embodiment, the third conductor plate 133 includes the fifth opening section 155 and the sixth opening section (the slot for reception) 156 separately from each other. The fourth embodiment is different from the third embodiment in that the sixth opening section (the slot for reception) 156 is absent and the antenna element for transmission 121 functions as an antenna element for reception as well. Therefore, the antenna element for transmission 121 is described as antenna element for transmission and reception (common use) 121 in this embodiment. Note that, roles of the antenna element for transmission and reception 121 are only increased and the antenna element for transmission and reception 121 may be the same as the antenna element for transmission 121 in the embodiments explained above. Consequently, an occupied area of the antenna elements in the third conductor plate 133 can be reduced.

Figure 4A:
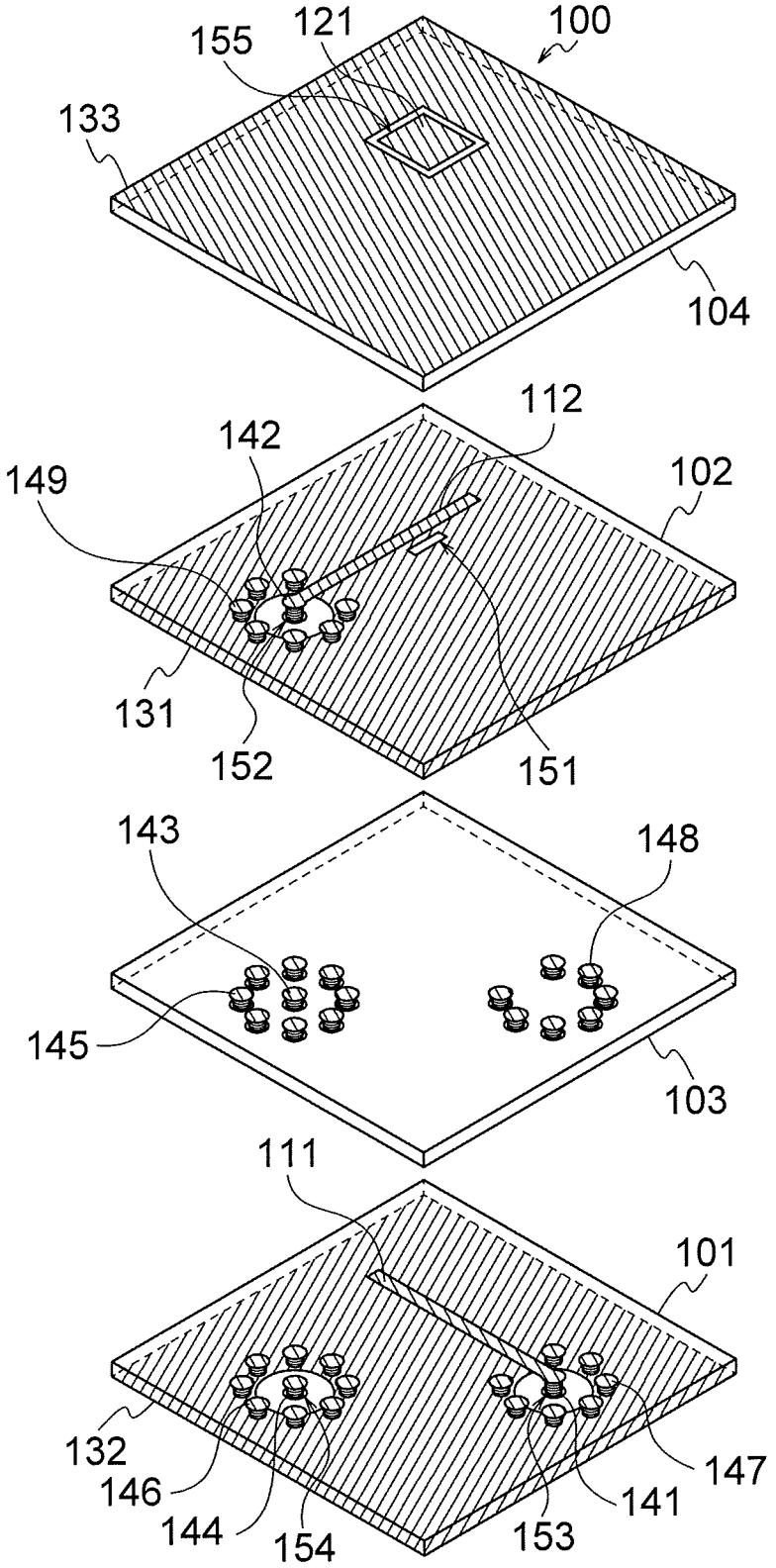
FIGS. 4A to 4D are diagrams for explaining an antenna device in a fourth embodiment.
Figure 4B:
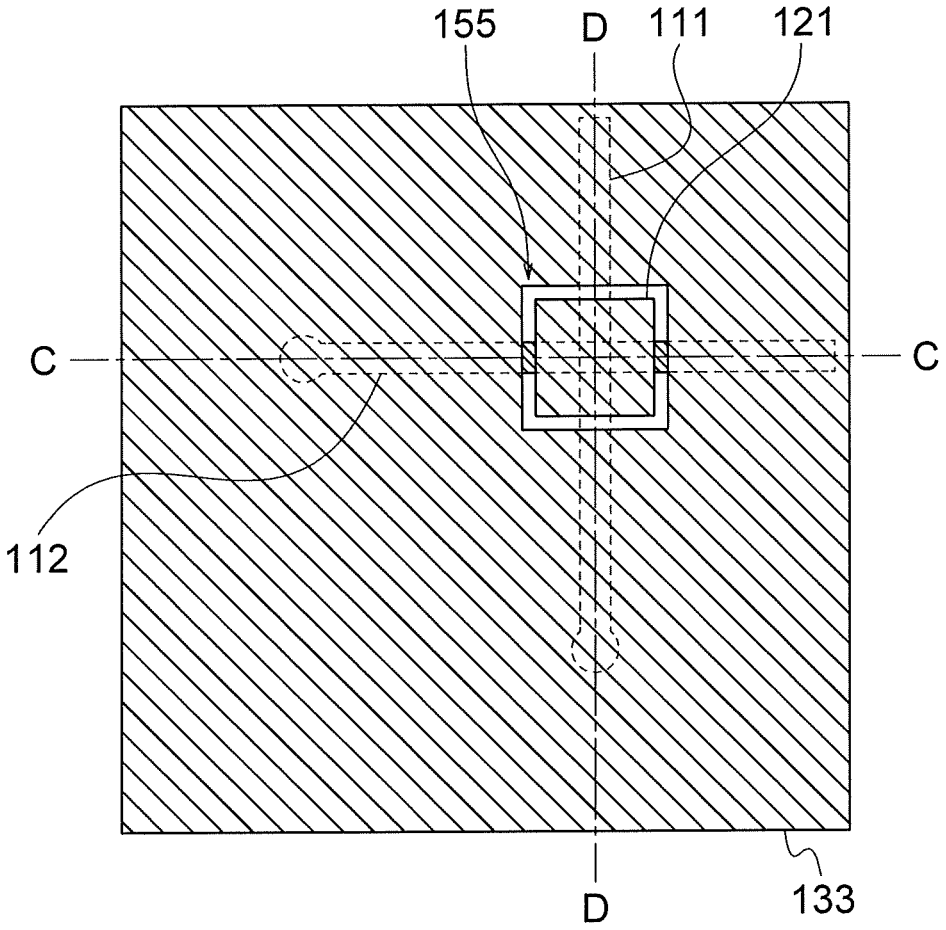

The antenna element for transmission and reception 121 is disposed to be located right above a part of the signal line for transmission 111 and right above a part of the signal line for reception 112. Consequently, the antenna element for transmission and reception 121, the signal line for reception 112, the first opening section (the slot for transmission) 151, and the signal line for transmission 111 overlap in the stacking direction and in a plan view as shown in FIG. 4B.

Figure 4C:
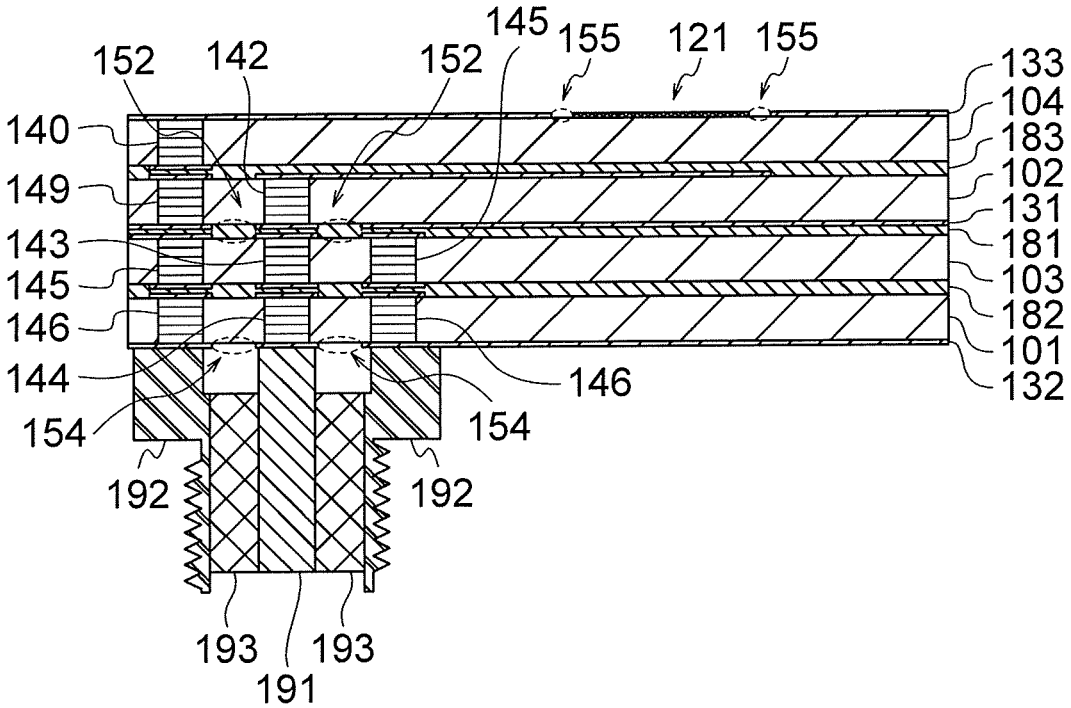

Since the sixth opening section (the slot for reception) 156 is changed to the antenna element for transmission and reception 121, a stripline for reception formed by the signal line for reception 112, the first conductor plate 131, and the third conductor plate 133 electromagnetically couples the antenna element for transmission and reception 121 and the signal line for reception 112. Consequently, the antenna element for transmission and reception 121 operates as a proximately-coupled feeding type patch antenna. Therefore, a reception signal is transferred from the antenna element for transmission and reception 121 to the signal line for reception 112. As shown in FIG. 4C, a reception path from the signal line for reception 112 to the fourth via 144 is not changed. Therefore, the reception signal is received as in the embodiments explained above.

Figure 4D:
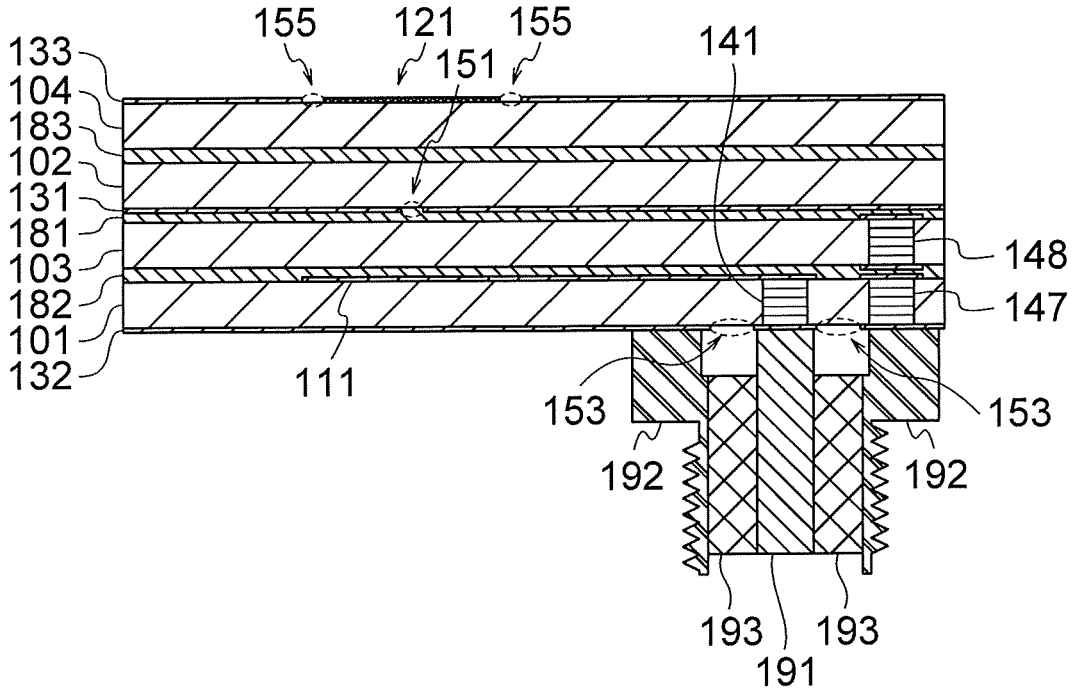

As shown in FIG. 4D, a transmission path is the same as the transmission path in the third embodiment. That is, a transmission signal is transferred from the signal line for transmission 111 to the antenna element for transmission and reception 121 by a microstrip line for transmission (when the second conductor plate 132 is absent) or a stripline for transmission (when the second conductor plate 132 is present), as in the third embodiment. Therefore, the transmission signal can be transmitted and a transmission characteristic stabilizes as in the embodiments explained above.

As described above, according to this embodiment, unnecessary radiation toward the upper side of the antenna device 100 can be prevented by the third conductor plate 133. The transmission characteristic can be further improved than in the second embodiment. Since the antenna element is used for both transmission and reception, an occupied area of the antenna element can be further reduced than in the third embodiment.

Fifth Embodiment

Figure 5A:
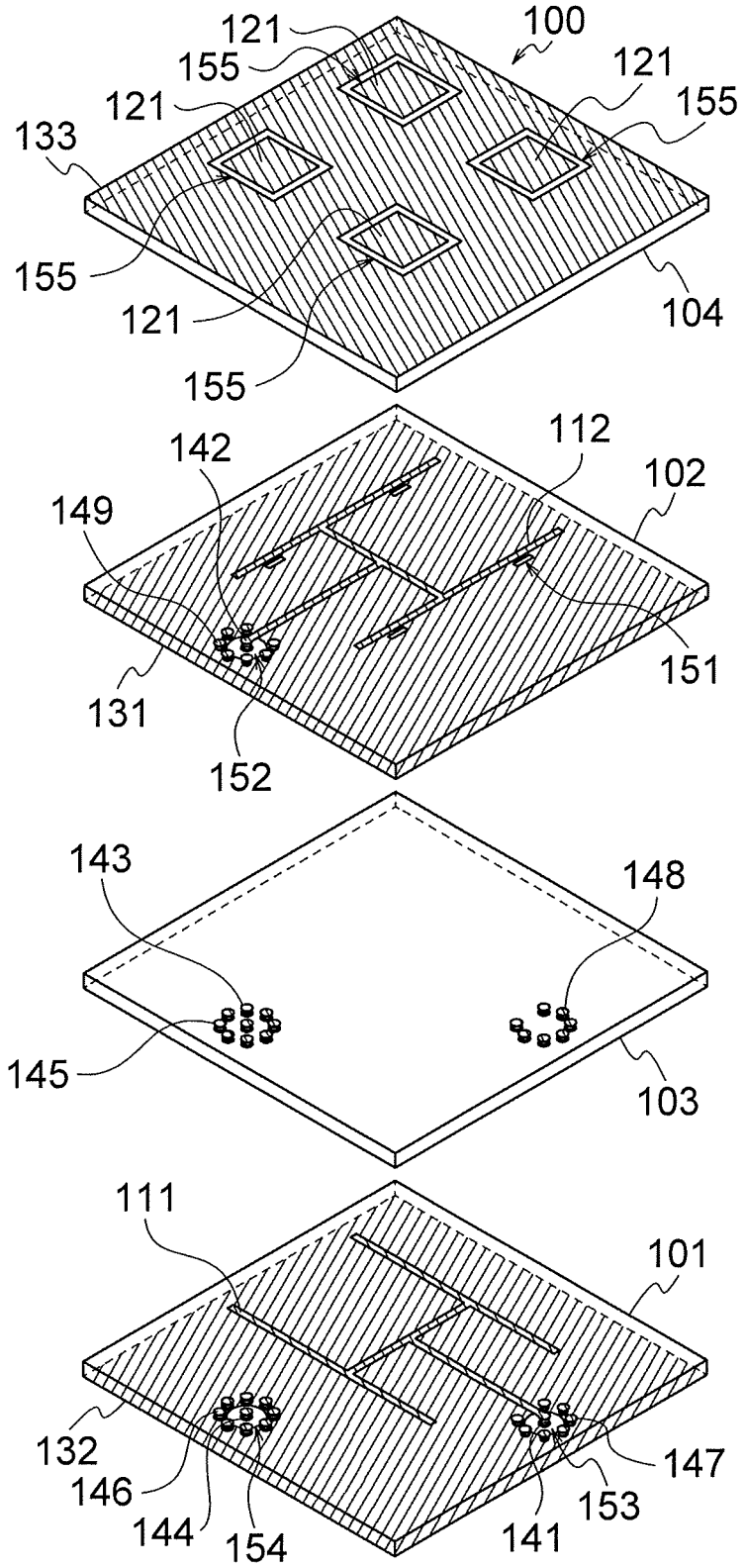
FIGS. 5A and 5B are diagrams for explaining an antenna device in a fifth embodiment.
Figure 5B:
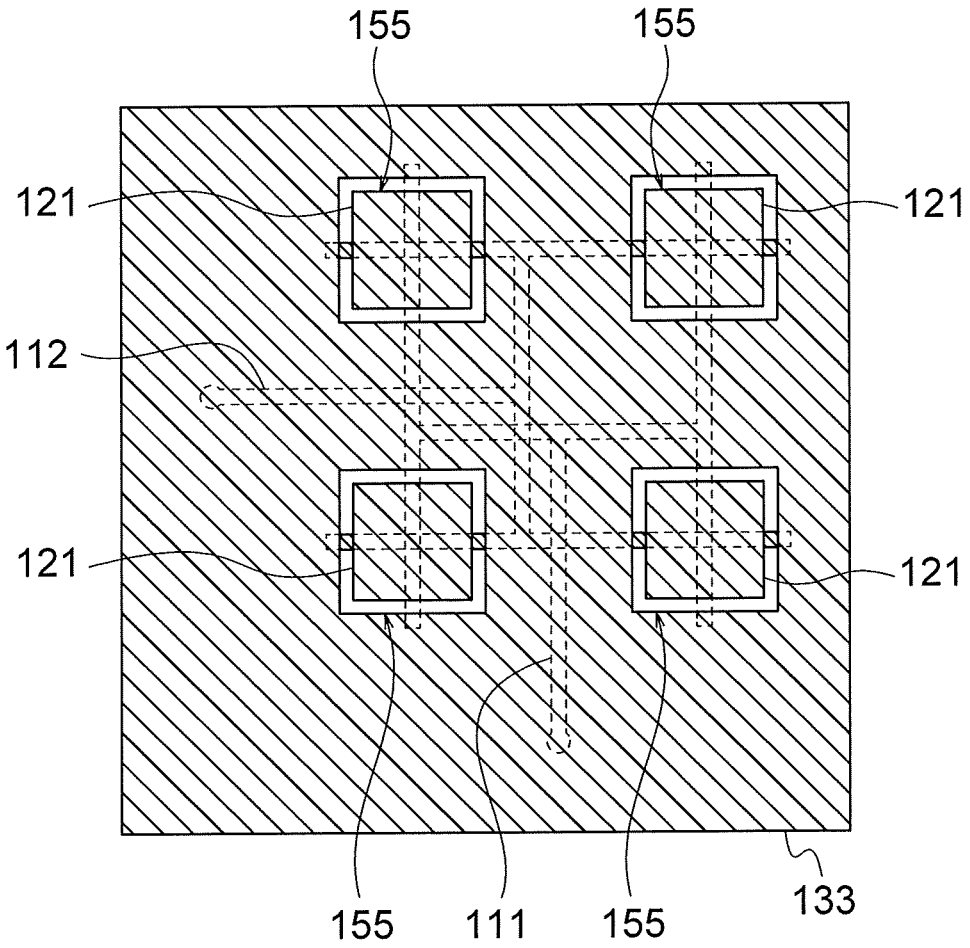

FIGS. 5A and 5B are diagrams for explaining an antenna device in a fifth embodiment. An exploded perspective view is shown in FIG. 5A and a top view is shown in FIG. 5B. A C-C sectional view and a D-D sectional view are omitted because the C-C sectional view and the D-D sectional view are the same as the C-C sectional view and the D-D sectional view in the fourth embodiment.

The fifth embodiment is different from the fourth embodiment in that the third conductor plate 133 includes a plurality of antenna elements for transmission and reception 121 and a plurality of fifth opening sections 155. That is, transmission and reception is performed by a plurality of antenna elements in the fifth embodiment. Consequently, an antenna gain and directivity of the antenna device 100 can be further improved. Incidentally, four antenna elements are shown in FIG. 5. However, the number of antenna elements may be decided as appropriate according to specifications of the antenna device 100.

Since the plurality of antenna elements for transmission and reception 121 are present, a transmission path and a reception path in this embodiment branch to a plurality of transmission paths and a plurality of reception paths. As shown in FIGS. 5A and 5B, the signal line for transmission 111 in this embodiment is formed in a shape having branches in order to divide a transmission signal to the antenna elements for transmission and reception 121. The signal line for reception 112 in this embodiment is formed in a shape having branches in order to combine reception signals in the antenna elements for transmission and reception 121.

The shapes of the branches of the signal line for transmission 111 and the signal line for reception 112 may be decided as appropriate according to the specifications and the like of the antenna device 100. The shape of the branches may be a shape for serially feeding electric power to the antenna elements for transmission and reception 121 or may be a shape for performing partial parallel power feeding in which serial power feeding and parallel power feeding are combined. For example, the signal line for transmission 111 and the signal line for reception 112 shown in FIG. 5A are four-branch circuits in which T branches in two stages are cascade-connected.

According to the branching of the signal line for transmission 111 and the signal line for reception 112, all of the plurality of antenna elements for transmission and reception 121 are disposed to be located right above a part of the signal line for transmission 111 and right above a part of the signal line for reception 112. Consequently, the antenna device 100 in this embodiment operates as a complete-parallel feeding array antenna during transmission and during reception.

The signal line for transmission 111 and the signal line for reception 112 branch. However, for the respective antenna elements for transmission and reception 121, the configurations of the transmission path and the reception path are the same as the configurations in the fourth embodiment. Therefore, transmission and reception is possible as in the fourth embodiment.

As described above, an antenna gain and directivity can be further improved by the plurality of antenna elements than in the embodiments explained above.

Sixth Embodiment

Figure 6:
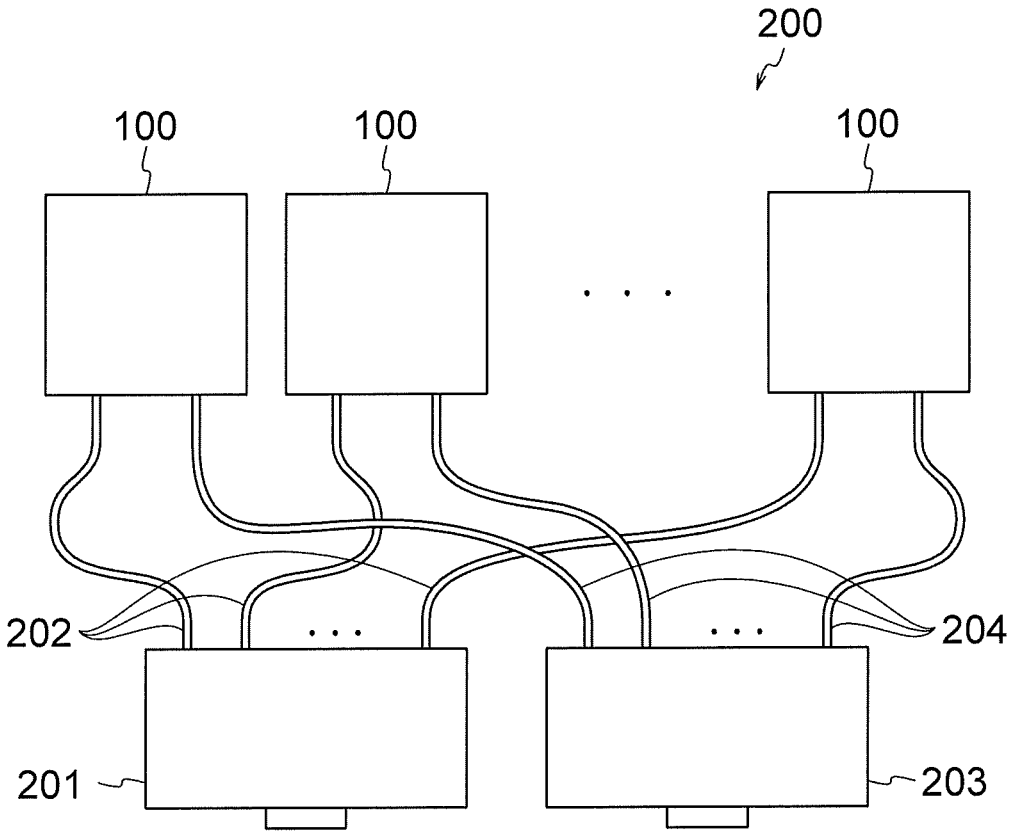
FIG. 6 is a block diagram showing an antenna apparatus in a sixth embodiment.

FIG. 6 is a block diagram showing an antenna apparatus in a sixth embodiment. An antenna apparatus 200 in the sixth embodiment includes a plurality of antenna devices 100, each of which is the antenna device 100 explained in the embodiments, a divider 201, a plurality of transfer lines for transmission 202, a combiner 203, and a plurality of transfer lines for reception 204. The divider 201 and the combiner 203 include input interfaces and output interfaces. As shown in FIG. 6, the divider 201 and the antenna devices 100 are connected by the plurality of transfer lines for transmission 202. The combiner 203 and the antenna devices 100 are connected by the plurality of transfer lines for reception 204.

The antenna apparatus 200 is an array antenna including a plurality of sub-arrays. That is, the antenna devices 100 in the embodiments explained above are used as the sub-arrays of the array antenna. From the viewpoint of an antenna gain and directivity, the antenna devices 100 used as the sub-arrays are preferably the antenna device 100 in the fifth embodiment. However, the antenna devices 100 used as the sub-arrays may be the antenna device 100 in any of the embodiments explained above. All the sub-arrays do not have to be the antenna device 100 in the same embodiment.

The divider 201 is connected to, via the input interface of the divider 201, a circuit or the like that generates a transmission signal. The transmission signal transferred from the circuit or the like is divided by the divider 201 and transferred to the antenna devices 100 via the output interfaces of the divider 201 and the transfer lines for transmission 202.

In order to maximize a gain of a transmitting antenna, the divider 201 may divide the transmission signal to equalize amplitudes and phases. Alternatively, the divider 201 may divide the transmission signal to have phase differences in order to perform scanning in a beam direction.

The transmission signal from the transfer line for transmission 202 is transferred to the land section at the lower end of the first via 141 of the antenna device 100. Consequently, the transmission signal passes through the transmission path explained in the embodiments and finally radiated as an electromagnetic wave.

The combiner 203 receives reception signals with the antenna devices 100 via the input interfaces of the combiner 203 and the transfer lines for reception 204. The combiner 203 combines the reception signals to thereby generate a combined signal.

In order to maximize a gain of a receiving antenna, the combiner 203 may combine the reception signals after equalizing amplitudes and phases. Alternatively, the combiner 203 may combine the reception signals after giving phase differences to the reception signals in order to change a reception direction.

The combiner 203 is connected to a circuit or the like that receives a combined signal via an output interface of the combiner 203. Thus, the combined signal is transferred to the circuit via the output interface.

The reception signal in the transfer line for reception 204 passes through the reception path of the antenna device 100 explained in the embodiments, and the reception signal is received by the transfer line for reception 204 from the land sections at the lower ends of the fourth vias 144 of the antenna device 100.

The transfer line for transmission 202 and the transfer line for reception 204 are, for example, coaxial cables but may be transfer lines such as wave-guides. Like the coaxial cable explained in the second embodiment, the transfer line for transmission 202 and the transfer line for reception 204 may be directly connected to the antenna device 100. Alternatively, the transfer line for transmission 202 and the transfer line for reception 204 may include converters. The converters may correspond to the input or output interface of the antenna device 100, the output interface of the divider 201, and the input interface of the combiner 203.

When directivity synthesis is performed in the array antenna, it is necessary to excite the antenna elements of the sub-arrays in desired amplitudes and desired phases. Therefore, when the sub-arrays have fluctuation in transmission amplitudes and transmission phases, excitation amplitudes and excitation phases of the sub-arrays deviate from desired values. Consequently, it is likely that radiation directivity of the entire array antenna is deteriorated with respect to a desired characteristic. Further, it is likely that an electromagnetic wave radiated in a direction other than a desired direction becomes an interfering wave with an antenna other than a communication partner antenna. Therefore, strict specifications are sometimes decided for radiation directivity of a transmitting antenna.

On the other hand, the antenna apparatus 200 in the sixth embodiment uses the antenna devices 100 having a stable transmission characteristic as the sub-arrays. Therefore, the amplitude and the phase of the transmission signal can be stably excited in the antenna apparatus 200. Therefore, even when strict radiation directivity is requested for transmission, the request can be satisfied by the antenna apparatus 200.

As described above, according to this embodiment, the antenna devices according to the embodiments explained above are used as the sub-arrays of the array antenna. Therefore, a transmission characteristic of the array antenna can be stabilized. The amplitude and the phase of the transmission signal can be stably excited.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

The invention claimed is:

1. An antenna device comprising:

a plurality of dielectric plates stacked in an up-down direction;

a first via piercing through a first dielectric plate included in the plurality of dielectric plates and configured to transfer a first high-frequency signal;

a signal line for transmission provided on an upper surface of the first dielectric plate and connected to an upper end portion of the first via;

a first conductor plate provided between a second dielectric plate and a third dielectric plate, the second dielectric plate being in an upper layer than the first dielectric plate, and the third dielectric plate being in an intermediate layer between the first dielectric plate and the second dielectric plate;

a first opening section provided right above a part of the signal line for transmission and piercing through the first conductor plate;

an antenna element for transmission provided right above the first opening section;

a signal line for reception provided on an upper surface of the second dielectric plate and configured to transfer a second high-frequency signal;

a second via piercing through the second dielectric plate and connected to the signal line for reception at an upper end portion;

one or more third vias respectively piercing, right under the second via, through a corresponding dielectric plate among the plurality of dielectric plates, the corresponding dielectric plate being present between the first dielectric plate and the second dielectric plate;

a second opening section piercing through the first conductor plate and including one of the third vias on an inner side; and a fourth via piercing through the first dielectric plate right under the second via.

2. The antenna device according to claim 1, wherein:

the signal line for transmission and the first conductor plate configure a microstrip line or a stripline;

when the first high-frequency signal is transferred from the first via to the signal line for transmission, the signal line for transmission and the antenna element for transmission are electromagnetically coupled by the microstrip line or the stripline; and the first high-frequency signal is transferred to the antenna element for transmission by the electromagnetic coupling.

3. The antenna device according to claim 1, further comprising a second conductor plate provided further on a lower side than the first dielectric plate.

4. The antenna device according to claim 3, further comprising a plurality of first via sets including pluralities of vias, the vias respectively piercing through dielectric plates present between the first conductor plate and the second conductor plate, and the vias being disposed side by side in the up-down direction, wherein the plurality of first via sets are disposed on an arc centering on at least any one of vias, the one of vias being present between the first conductor plate and the second conductor plate, and the one of vias being configured to transfer a high-frequency signal.

5. The antenna device according to claim 3, further comprising:

a coaxial connector for transmission including a first inner conductor and a first outer conductor; and a coaxial connector for reception including a second inner conductor and a second outer conductor, wherein:

the first inner conductor conducts with the first via;

the first outer conductor conducts with the second conductor plate;

the second inner conductor conducts with the fourth via; and the second outer conductor conducts with the second conductor plate.

6. The antenna device according to claim 1, further comprising:

a fourth dielectric plate in an upper layer than the second dielectric plate;

a third conductor plate provided on an upper surface of the fourth dielectric plate or between dielectric plates in upper layers than the fourth dielectric plate; and a third opening section provided right above the first opening section and piercing through the third conductor plate, wherein the antenna element for transmission is provided on an inner side of the third opening section.

7. The antenna device according to claim 6, wherein:

a part of the signal line for reception is present right under the antenna element for transmission; and the second high-frequency signal is transferred to the signal line for reception when the signal line for reception and the antenna element for transmission are electromagnetically coupled.

8. The antenna device according to claim 7, wherein:

the signal line for transmission includes a plurality of branches;

for each of the branches of the signal line for transmission, the first opening section is present right above a part of the branch;

the signal line for reception includes a plurality of branches;

the branches of the signal line for reception are present right above the respective first opening sections; and for each of the first opening sections, the antenna element for transmission is present.

9. The antenna device according to claim 6, further comprising a fourth opening section provided right above a part of the signal line for reception and piercing through the third conductor plate, wherein the second high-frequency signal is transferred to the signal line for reception when the fourth opening section operates as a slot antenna.

10. The antenna device according to claim 6, further comprising a plurality of second via sets including pluralities of vias for protection, the vias respectively piercing through dielectric plates present between the first conductor plate and the third conductor plate, and the vias being disposed side by side in the up-down direction, wherein the plurality of second via sets are disposed on an arc centering on at least any one of vias, the one of vias being present between the first conductor plate and the third conductor plate, and the one of vias being configured to transfer a high-frequency signal.

11. The antenna device according to claim 1, further comprising an adhesive layer configured to bond the dielectric plates included in the plurality of dielectric plates and adjacent to each other.

12. An antenna apparatus comprising:

a plurality of antenna devices, each of which is the antenna device according to claim 1;

a divider;

a plurality of transfer lines for transmission configured to connect the divider and the respective plurality of antenna devices;

a combiner; and a plurality of transfer lines for reception configured to connect the combiner and the respective plurality of antenna devices.

* * * * *